US009907132B2

(12) United States Patent
Zulim et al.

(10) Patent No.: US 9,907,132 B2
(45) Date of Patent: Feb. 27, 2018

(54) LIGHTING CONTROL SYSTEM FOR INDEPENDENT ADJUSTMENT OF COLOR AND INTENSITY

(71) Applicant: ABL IP Holding LLC, Conyers, GA (US)

(72) Inventors: Dalibor Zulim, Conyers, GA (US); Richard Lee Westrick, Jr., Social Circle, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 14/926,107

(22) Filed: Oct. 29, 2015

(65) Prior Publication Data

US 2017/0127489 A1 May 4, 2017

(51) Int. Cl.
*H05B 33/08* (2006.01)

(52) U.S. Cl.
CPC ..... *H05B 33/0845* (2013.01); *H05B 33/0857* (2013.01)

(58) Field of Classification Search
CPC ..... H05B 33/0845; H05B 33/0857
USPC ..... 315/297
See application file for complete search history.

(56) References Cited

U.S. PATENT DOCUMENTS 6,441,558 B1 * 8/2002 Muthu ..... H05B 33/0863 315/118
6,967,448 B2 11/2005 Morgan et al.
7,288,902 B1 10/2007 Melanson
7,334,917 B2 2/2008 Laski
7,498,753 B2 * 3/2009 McAvoy ..... H05B 33/086 315/158
7,667,408 B2 2/2010 Melanson et al.
8,008,866 B2 8/2011 Newman, Jr. et al.
8,115,419 B2 2/2012 Given et al.
8,232,733 B2 7/2012 Newman, Jr. et al.
8,319,452 B1 11/2012 Hamel et al.
8,354,803 B2 1/2013 Newman, Jr. et al.
8,358,089 B2 1/2013 Hsia et al.
8,456,109 B1 6/2013 Wray
8,466,628 B2 6/2013 Shearer et al.
8,536,794 B2 9/2013 Melanson et al.
8,618,744 B2 12/2013 Briggs
8,638,044 B2 1/2014 Briggs
8,643,304 B2 2/2014 Hamel et al.
8,643,308 B2 2/2014 Grajcar
(Continued)

OTHER PUBLICATIONS

Biery, et al., "Controlling LEDs", Lutron Electronics Co., Inc., May 2014, 20 pages.

*Primary Examiner* — Dylan White
(74) *Attorney, Agent, or Firm* — Kilpatrick Townsend & Stockton, LLP

(57) ABSTRACT

A lighting control system allows user control of the color features of controllable light fixtures. Controlled color features may include the color, color temperature, tint, or other qualities related to the color of the light. Control of the color features may be independent from control of the intensity of the light fixtures. The system may use light-emitting diode (LED) light fixtures, or fluorescent or incandescent light fixtures. The system may enable control of the color feature using a controllable driver/ballast and a dimmer control. The color feature may be adjusted along a color path of adjacent values in a suitable color space model.

20 Claims, 7 Drawing Sheets

(56) References Cited

U.S. PATENT DOCUMENTS

| | | | | |
|---|---|---|---|---|
| 8,710,754 | B2 | 4/2014 | Baddela et al. | |
| 8,736,183 | B2 | 5/2014 | Chao | |
| 8,823,289 | B2 | 9/2014 | Linz et al. | |
| 8,847,504 | B2 | 9/2014 | Setomoto et al. | |
| 8,912,734 | B2 | 12/2014 | Melanson et al. | |
| 8,937,434 | B2 | 1/2015 | Datta | |
| 9,000,680 | B2 | 4/2015 | Melanson et al. | |
| 2011/0095703 | A1* | 4/2011 | Wilson | H05B 33/0863 315/294 |
| 2012/0153836 | A1 | 6/2012 | Shimizu | |
| 2012/0229032 | A1* | 9/2012 | Van De Ven | H05B 33/086 315/151 |
| 2012/0242247 | A1 | 9/2012 | Hartmann et al. | |
| 2013/0069561 | A1* | 3/2013 | Melanson | H05B 33/0815 315/297 |
| 2013/0119872 | A1* | 5/2013 | Chobot | H05B 33/0863 315/185 R |
| 2013/0175931 | A1 | 7/2013 | Sadwick | |
| 2014/0252967 | A1 | 9/2014 | van de Ven et al. | |
| 2014/0300283 | A1 | 10/2014 | Lee et al. | |
| 2014/0312775 | A1 | 10/2014 | Steedly | |
| 2014/0312777 | A1 | 10/2014 | Shearer et al. | |
| 2014/0333216 | A1* | 11/2014 | Zhang | H05B 33/0827 315/185 R |
| 2015/0035443 | A1 | 2/2015 | Hill et al. | |
| 2015/0091472 | A1* | 4/2015 | Kadotani | H05B 33/0815 315/294 |
| 2015/0097489 | A1 | 4/2015 | Wu et al. | |
| 2015/0115800 | A1 | 4/2015 | Vos et al. | |
| 2015/0115823 | A1 | 4/2015 | Serra et al. | |

* cited by examiner

LIGHTING CONTROL SYSTEM FOR INDEPENDENT ADJUSTMENT OF COLOR AND INTENSITY

FIELD OF THE INVENTION

This invention relates generally to the field of lighting control, specifically control of lighting color and intensity.

BACKGROUND OF THE INVENTION

The existence of lighting control systems aimed at color control is well-established for professional users, especially for theater settings, but it is becoming common for users of commercial and residential lighting systems to desire the same functionality. However, existing control systems, such as those that use DMX or DALI controllers or wireless controllers such as Zigbee or Bluetooth controllers, are often complex to configure, relatively expensive and require additional wiring (e.g., CAT5 cable) to control the color, color temperature and intensity of the light. This invention addresses the need for an inexpensive controller using a standard phase or 0-10V wall dimmer to achieve color mixing, color temperature control of white light, and also the light intensity (dimming) of the controllable fixture. Independent control of the dimming and color features of the light fixtures may be achieved.

BRIEF SUMMARY

The implementations of the invention described here are intended to enable continuous control of the color features of controllable light fixtures, using readily available components. Controlled color features may include the color, color temperature, tint, or other qualities related to the color of the light. Control of the color features may be independent from control of the intensity of the light fixtures. The invention may be implemented with light-emitting diode (LED) light fixtures, but may also be implemented with fluorescent or incandescent light fixtures. One implementation of the invention may enable control of the color feature using a system comprising a controllable driver/ballast and a dimmer control. The controllable driver may have analog control input ports connected to the dimmer control, output ports to control the LEDs, and a programmable microcontroller.

In one implementation of the invention, the dimmer control may receive user input to control the light fixtures. Common functions the user might control may include a power state (i.e., turning the lights on and off), dimming the intensity of the light fixtures, and adjusting the color feature of the light fixtures. Other common functions will be apparent to those skilled in the art.

In an implementation of the invention, if the user wishes to adjust a color feature of the lights, the user may use the dimmer control to provide a particular action or series of actions to the controllable driver to enter a color adjustment mode. For example, one such series could comprise moving the slider from minimum position to maximum position three times within a certain time period. The driver may be programmed to interpret the actions, and may provide the appropriate output signals to hold the intensity level of the light fixtures at a constant level while the color feature is adjusted. The system may indicate a change of mode with a signal, such as blinking the lights. While the system is in color-adjustment mode, the user may use the dimmer control to send a signal to the driver. The color feature may be continuously adjusted, relative to the continuous motion of the dimmer control. When the user has completed the adjustment, the user may enter a further action or series of actions to return to the default mode. One skilled in the art will appreciate that there are many such series of actions from the user, and many such indicator signals from the system, that could be used for the described purposes.

In one implementation of the invention, the adjustment of the color feature using the dimmer control may be characterized by a smooth transition between contiguous values of the color feature. In another implementation, the adjustment of the feature may be along a color path of contiguous values between two endpoint values. For example, the feature of color temperature could be adjusted along a color path between warm white and cool white, allowing a smooth transition between adjacent values of white color temperatures along the path. In a different implementation of the invention, the continuous adjustment of the color feature may be cyclical, such as along a color path of a rainbow color spectrum.

In one implementation of the invention, the color feature to be adjusted may be a white-light color temperature (e.g., adjusting between warm white and cool white). In another implementation, the color feature to be adjusted may be a tint (i.e., a delta-UV shift). In a different implementation, the color feature to be adjusted may be a single color of the red-green-blue (RGB) or red-green-blue-white (RGBW) color models; other appropriate color models will be readily apparent to those skilled in the art. In a further implementation, the color feature to be adjusted may be a combination of colors, such as adjusting the red-white color level, or adjusting the color level along a standard rainbow spectrum.

In an implementation of the invention, the system may further comprise one or more additional dimming controls to provide control over particular light fixture functions. The additional dimming controls may communicate with the controllable driver through multiple analog control input ports of the driver. Alternatively, the system may further comprise multiple controllable drivers, such that each controllable driver is connected to a single dimmer control, and controls a single color feature (e.g., the red level of the light fixtures).

In another implementation of the invention, a single dimmer control may allow the user to adjust different color features by entering different series of actions. For example, the user might enter color-adjustment mode by toggling the switch from minimum to maximum three times, within a certain time period. In this example, once the system is in color-adjustment mode, the user might toggle the dimming switch once to adjust the red color level, twice to adjust the green color level, or three times to adjust the blue color level. Those skilled in the art will appreciate that many such series of actions could be used in many combinations, to provide control of any number of color features.

The foregoing, and the descriptions and examples included hereafter, are provided for purposes of illustrating, explaining, and describing aspects of the present invention. Further modifications and adaptations to these examples will be apparent to those skilled in the art and may be made without departing from the scope or spirit of the invention. The exemplary systems and methods represented here may be implemented independently, in conjunction with a different one of the systems described, or in conjunction with a system not described herein.

DETAILED DESCRIPTION

Figure 1:
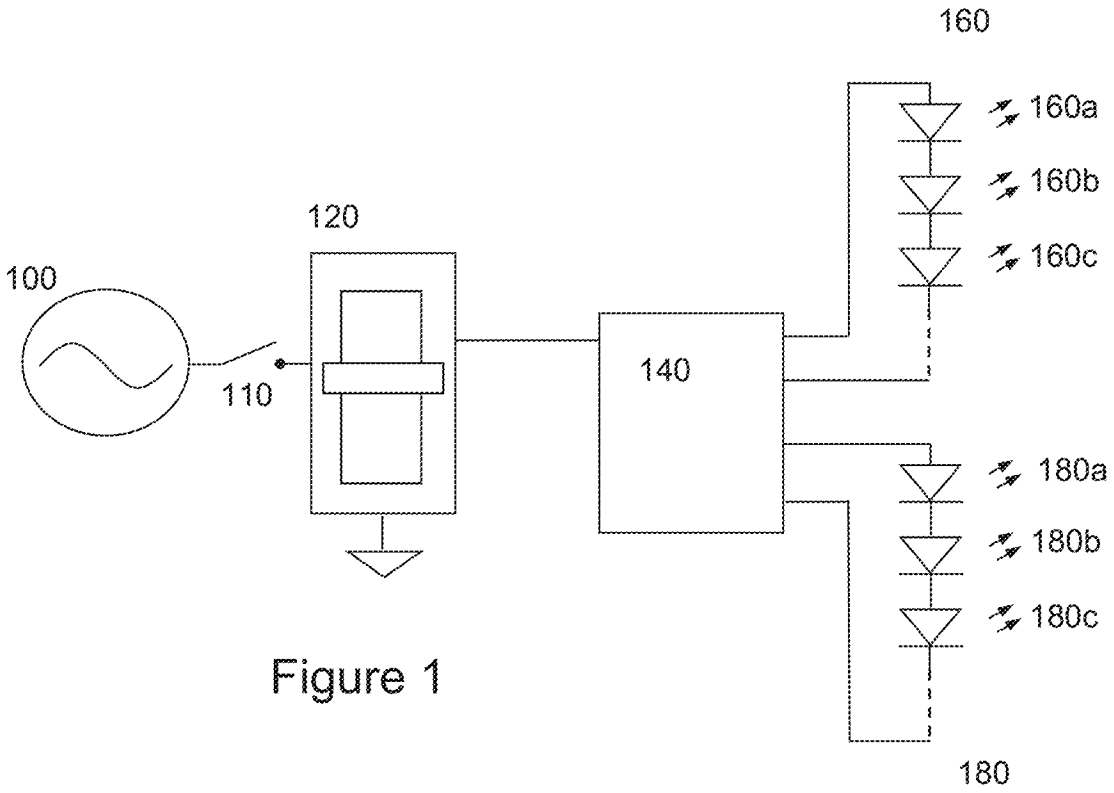
FIG. 1 is a block diagram representing an exemplary configuration of the system.
Figure 2:
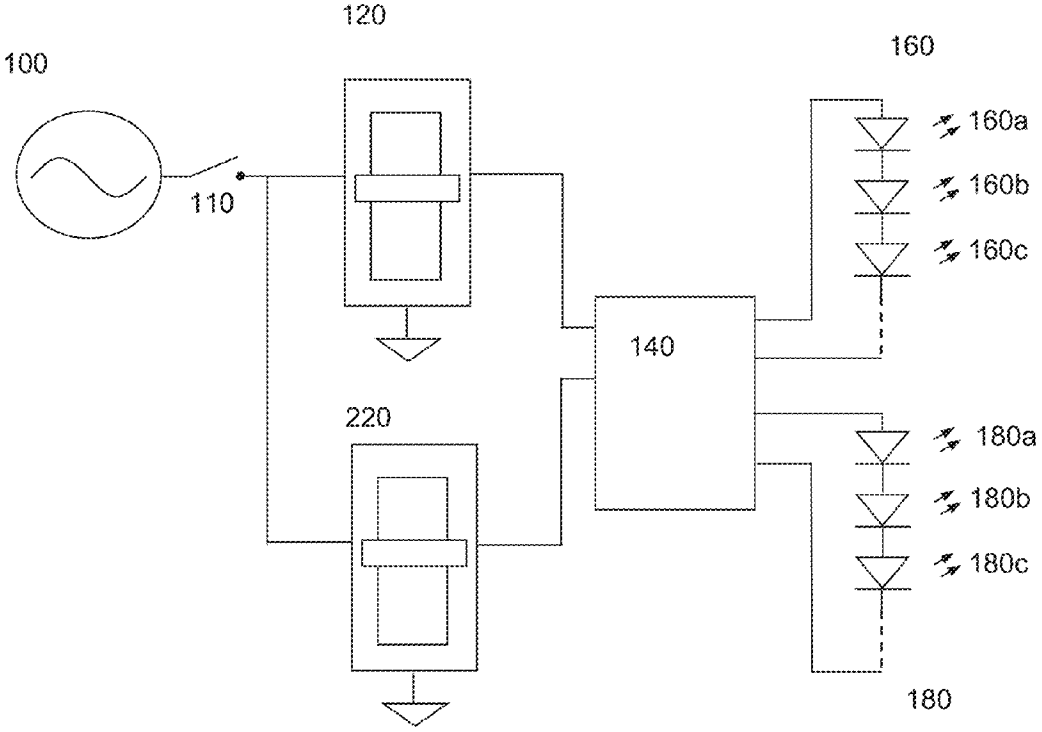
FIG. 2 is a block diagram representing an exemplary configuration of the system with multiple dimming controls.
Figure 3:
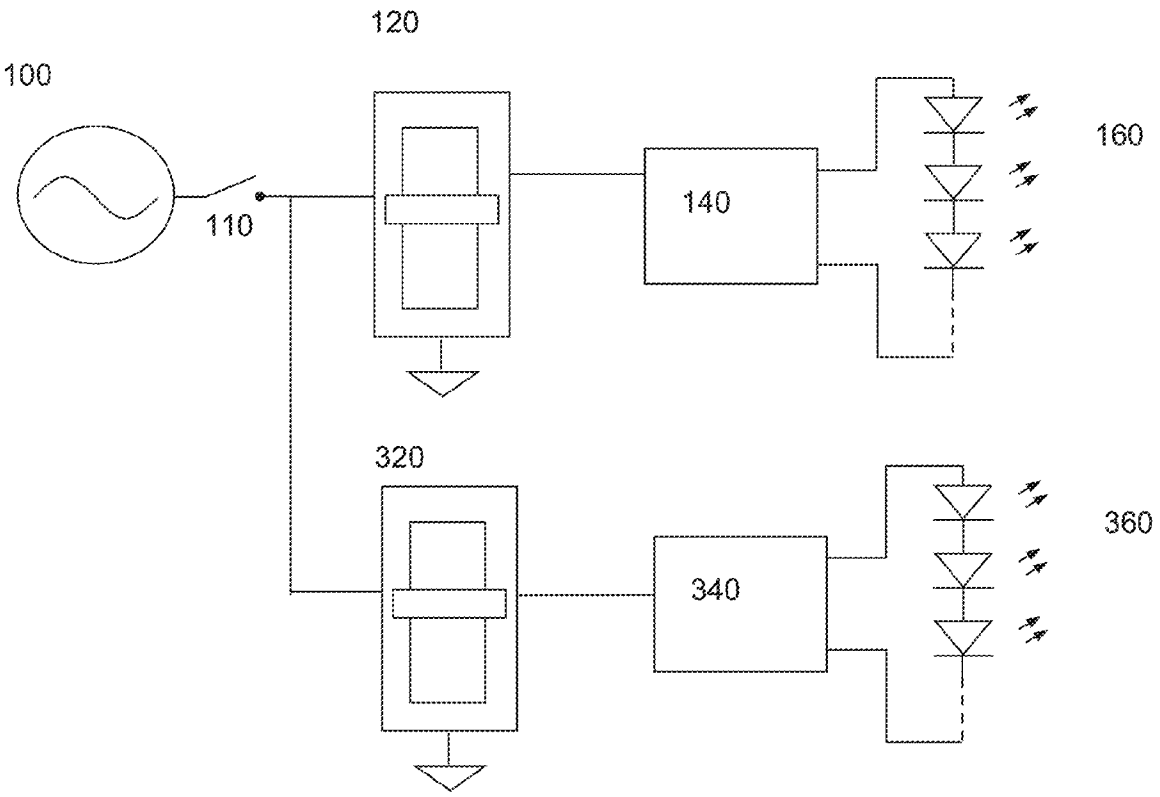
FIG. 3 is a block diagram representing an exemplary configuration of the system with multiple controllable drivers.

FIG. 1 depicts an exemplary configuration of one implementation of the system. A power source 100 may be connected to a dimming control 120; an on/off switch 110 may be included in the connection in between. The power source 100 is shown as an AC power supply, but any suitable power source may be used. The dimmer control 120 may be connected to an input on a controllable driver 140, which receives user input actions from the dimmer control 120 via the connected input. The on/off switch 110 may also control power to the driver 140, although this configuration is not shown. The controllable driver 140 also has outputs that are connected to two or more groups of LEDs 160 and 180, through which the driver 140 controls the light from the LEDs 160 and 180. The driver 140 may include a programmable microcontroller. The microcontroller may have a communication algorithm implemented, allowing the microcontroller to receive and interpret signals and provide appropriate control outputs to the light fixtures. A sliding dimmer control is shown in FIGS. 1-3, but any suitable dimmer control may be used, such as rotary, touch-sensitive pad, or other user input device. In addition, the dimmer control 120 may be a standard 0-10V dimmer, a phase dimmer, or any other dimmer control type, as apparent to those skilled in the art. Fluorescent or incandescent light sources may also be used instead of LEDs.

The controllable driver 140 may control the total intensity of light output from the LED groups 160 and 180 by adjusting the relative voltage or current level of the groups, or by adjusting the relative activation time (i.e., duty cycle). For example, to achieve a medium intensity, the driver 140 may adjust the relative activation time to approximately 50%. The intensity may be adjusted according to signals received from user input actions, as described in connection with FIG. 4. In addition, the driver 140 may control the output of the multiple groups of LEDs 160 and 180 in order to achieve combination effects from the multiple color features, by adjusting the voltage or current level or the relative activation time of particular groups with respect to others. For example, to achieve a relatively warm white color, the driver 140 may adjust the relative activation times of a group of warm white LEDs 160 and cool white LEDs 180 to have relative activation times of approximately 67%, and 33%. As a different example, to achieve a cyan color, the driver 140 may adjust the relative activation times of groups of red, green, and blue LEDs (not depicted in FIG. 1) to have relative activation times of approximately 0%, 50%, and 50%.

FIG. 2 shows an alternate implementation of the system, in which multiple dimmer controls are included. In addition to the dimmer control 120, a second dimmer control 220 is connected to the power source 100, and further connected to an additional input on the controllable driver 140. The controllable driver may receive additional user input actions from the second dimmer control 220. For example, the first dimmer control 120 could provide user actions for controlling the total intensity of the light from the LEDs 160 and 180, while the second dimmer control 220 could provide user actions for controlling the combined color output of the LEDs 160 and 180. As an alternate example, the first dimmer 120 could provide user actions for controlling intensity or any color feature of the light from the LEDs 160 and 180, while the second dimmer control 220 could provide user actions for changing which mode is engaged by the driver 140. Further dimmer controls may be added, or other features of the light (e.g., RGB color components) may be controlled.

FIG. 3 shows a further alternate implementation of the system, in which multiple controllable drivers are included. In addition to the driver 140, a second controllable driver 340 receives user input actions from at least one dimmer control 320, and controls the light from a group of LEDs 360. For example, one configuration of the system could comprise a dimmer control 120 providing adjustment signals to driver 140 to control the intensity and color feature of white LEDs 160. This example configuration could further include a dimmer control 320 providing adjustment signals to driver 340 to control the intensity and color feature of red LEDs 360. Further dimmer controls or drivers may be added, or other color features may be controlled, without changing the inventive aspect of this implementation.

The described implementations of the invention enable a user to adjust multiple qualities of the light fixtures using as few as one dimmer control. Predetermined combinations of actions may be performed by the user using the dimmer control. When received and interpreted by the controllable driver, these actions may cause the driver to change mode and allow the user to adjust a different quality of the light. Since it is expected that the user may want to change the power state or dimming level more frequently than the color features, the controllable driver and dimmer control may have a default mode to control these functions of the lights, but this configuration may be changed without departing from the implemented invention.

Figure 4:
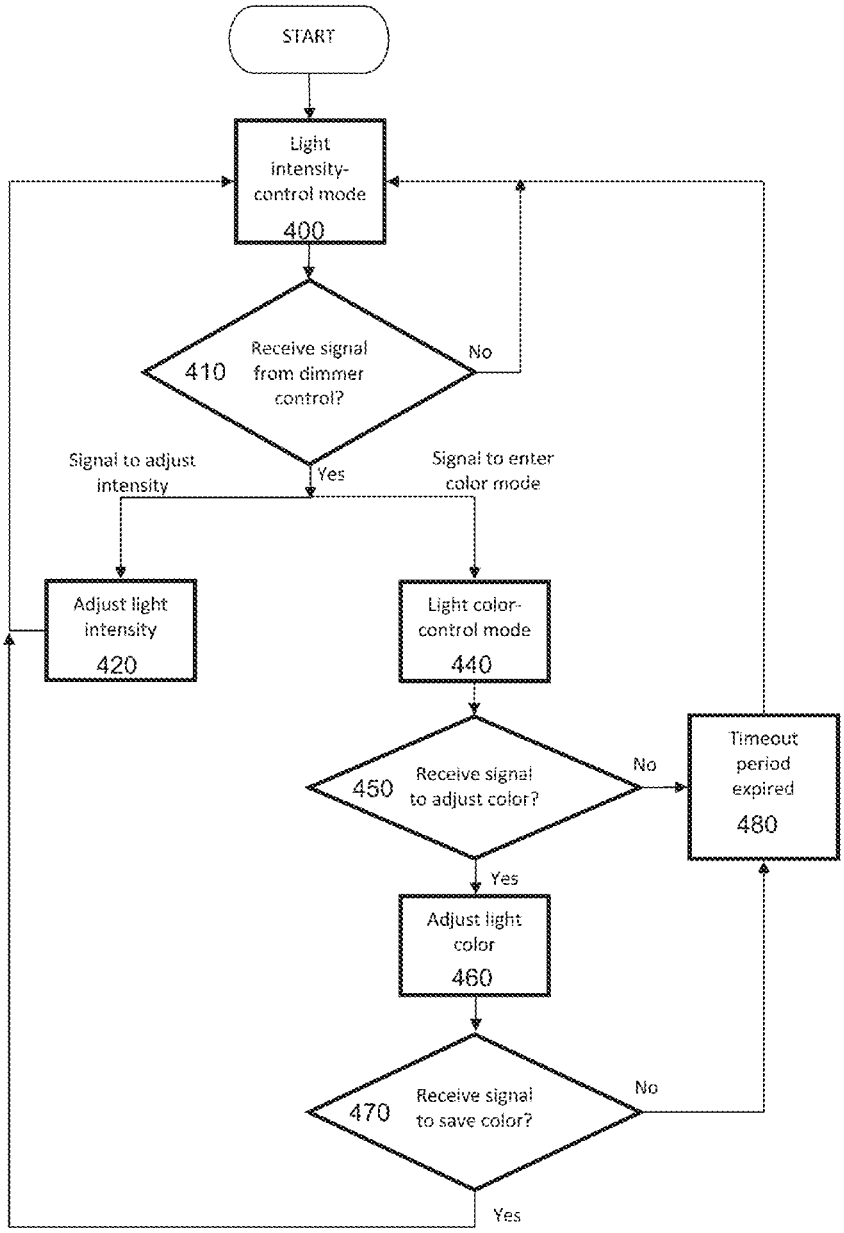
FIG. 4 is a flowchart representing exemplary steps for transitioning between modes of operation.

The steps of a particular exemplary implementation are shown in the flowchart of FIG. 4. In this example, the controllable driver may by default enter an intensity-control mode 400 upon power up. If the user wishes to adjust the intensity of the lights, the user may move the dimmer control to indicate an increase or decrease. The driver, upon receiving the input signals from these movements at step 410, may adjust the intensity of the LEDs (i.e., more or less light output) at step 420. If the user further wishes to adjust a color of the lights, the user may move the dimmer control to send a particular signal or series of signals to the controllable driver—for example, toggling the dimmer from minimum to maximum three times within a certain time period. Upon receiving these signals, the controllable driver may change mode from intensity-control 400 to color-control 440. The system could indicate that it is now in color-control mode 440 with an indicator signal, such as blinking the lights, or cycling briefly through several colors. If no further input is received from the user, the system may return to the intensity-control mode 400 after a short timeout period at step 480, possibly with a further indicator signal to alert the user of the mode change. While the driver is in color-adjustment mode 440, the user may move the dimmer control to adjust a color of the lights. The driver, upon receiving the input signals from these movements at step 450, may adjust the color of the LEDs at step 460. When the user has adjusted the color feature to preference, the user may enter a further action or series of actions, such as powering off the lights. Upon receiving and interpreting such action at step 470, the system may retain, or save, the adjusted color, such that upon powering on the lights, the lighting color matches the user's adjustments. The system may return to intensity-control mode 400 upon receiving the signal to save the adjusted color. If no actions are received indicating the user's intent to save the adjustment, after a short timeout period 480 the system may revert the color of the lights to the values prior to the user adjustments, and may return to the intensity-control mode 400, possibly with a further indicator signal to alert the user of the mode change. Although not depicted in FIG. 4, the system may alternatively save the adjusted color after the timeout period, before returning to the intensity-control mode 400.

Although the implementation described by FIG. 4 shows the system beginning in an intensity-control mode, this may be changed without departing from the invention implementation. In addition, one skilled in the art will recognize that there are many actions or series of actions from the user, and many indicator signals from the system, that could be used for the described purposes.

Figure 5:
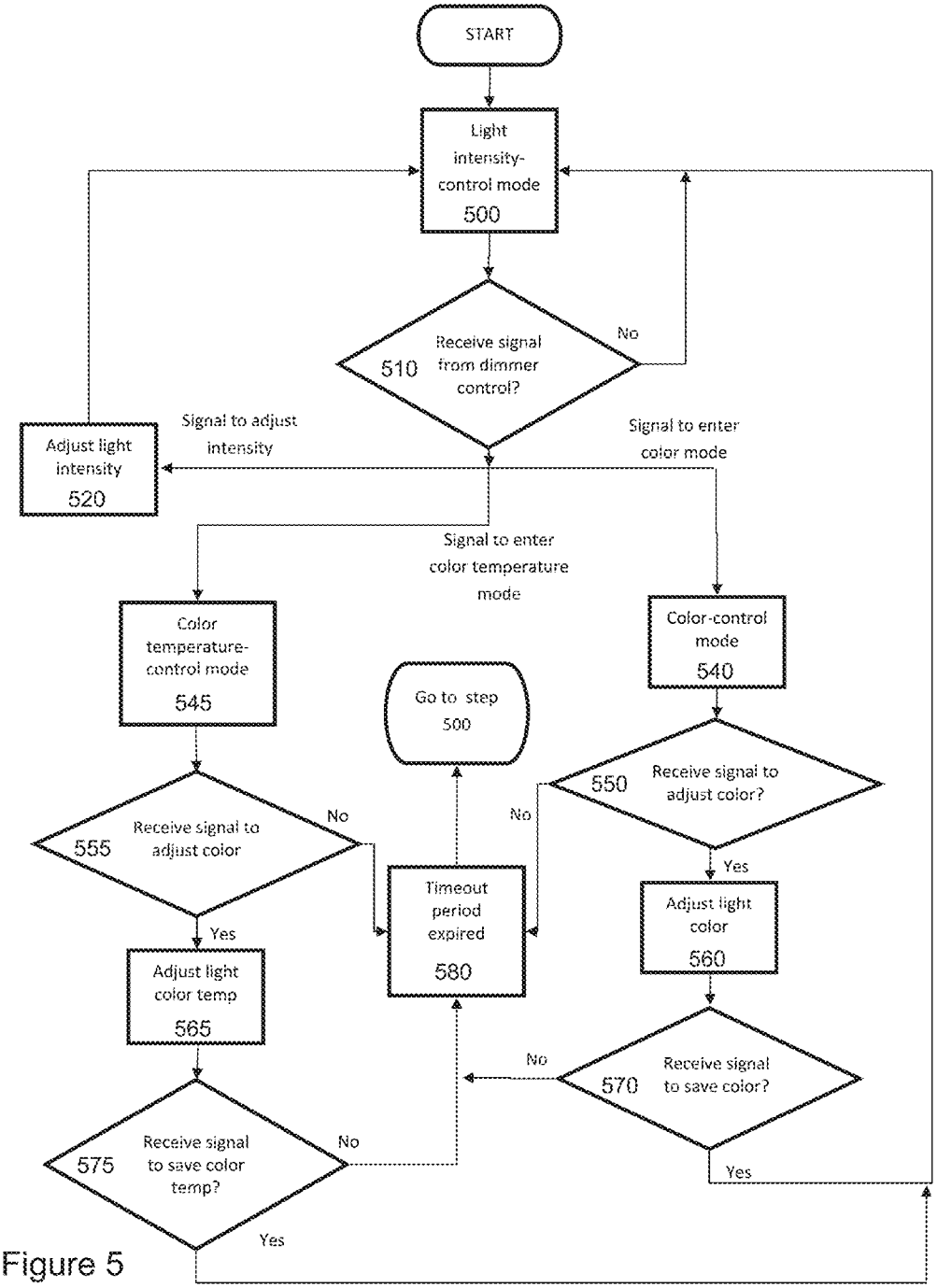
FIG. 5 is a flowchart representing exemplary steps for transitioning between modes of operation.

Alternative implementations of the control modes may be envisioned. As an alternative example, the steps shown in FIG. 4 may be easily applied to a color temperature-control mode, or other color features. In addition, additional color features may be controlled in modes accessible from additional combinations of user actions. For example, FIG. 5 shows steps that may be used to control the light qualities of intensity, color, and color temperature. In this example, the system begins in intensity-control mode 500. The user may use the dimmer control to enter signals at step 510. If the signals are to adjust the intensity, the driver may do so at step 520. If the user enters a particular signal or series of signals, the driver may change mode to a color-control mode 540. The user may also use the dimmer control to enter a different series of signals at step 510, whereupon the controllable driver may enter a color temperature-control mode 545. Subsequent steps to receive actions to adjust the color or color temperature (at 550 and 555, respectively), adjust the color or color temperature (at 560 and 565, respectively), and receive actions to save the adjusted color features (at 570 and 575, respectively) are shown, operating comparably to the steps and alternatives described in relation to FIG. 4.

In both FIGS. 4 and 5, it may be seen that alternative steps have been omitted for clarity. For example, the user may change their mind, and the actions to save the light color at 470 may be received, without first receiving adjustments at 460. Or, the actions may be received to enter color temperature-control mode at 545 while the controllable driver is in the color-control mode 540, without first returning to the intensity-control mode 500. Such steps and "error-checking" are not shown for the sake of simplicity, but the presence or absence of such steps are contemplated.

Figure 6:
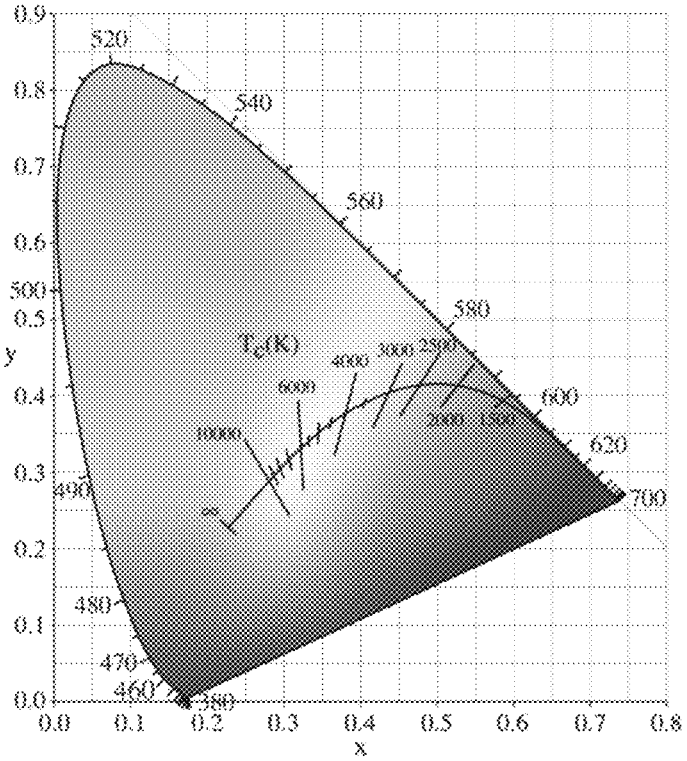
FIG. 6 is a representation of an exemplary color space model.

While in an appropriate control mode, the color features that may be adjusted may be any color-related quality that is produced by a light source. FIG. 6 depicts one suitable color space model of colors that may be perceived by most humans, specifically, the CIE 1931 color space. This color space depicts human-perceivable colors that may be produced by a RGB combination of light sources. Colors at the lower right corner are perceived as generally red, colors at the lower left corner are perceived as generally blue, and colors at the upper left curve are perceived as generally green, with all other perceivable colors falling between these extremes. In addition, the white-light color temperature curve is shown on FIG. 6. The curve illustrates the light that may be perceived by humans as "white," but may also be perceived as "warmer," containing more reds with a temperature around or below 2500 K, or as "cooler," containing more blues and having a temperature around or above 6000 K. In addition, the white-light curve may have a separate color feature of tint, or delta-uv (not shown in FIG. 6), which may be represented as an axis perpendicular to the depicted color space. In addition to the color, color temperature, and tint color features that may be represented by FIG. 6, other color features, including those from other models, may be implemented. For example, the qualities of hue, saturation, chromaticity, or luminance may be suitable as adjustable color features.

Figure 7A:
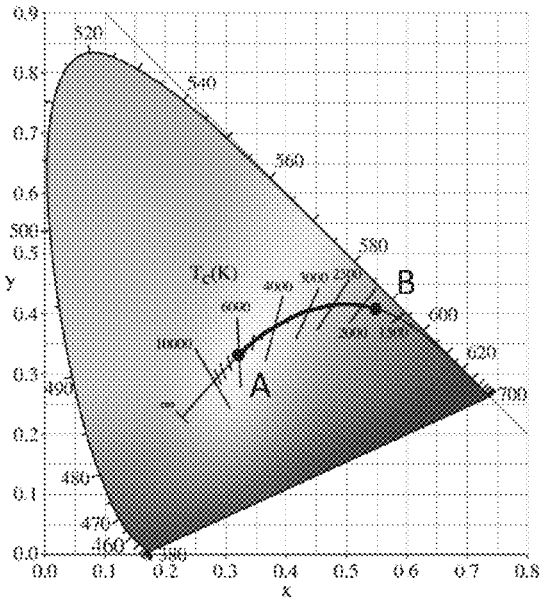
FIGS. 7*a* and 7*b* are representations of exemplary color paths for adjustment.

In one implementation of the invention, the color feature may be color temperature, and the adjustment of the feature may be along a color path of adjacent values in a suitable model. One such color path is illustrated by FIG. 7*a*, shown between the endpoints A and B. In this example, the maximum position of the dimmer control could correspond to point A at the highest value of the color path, such as an LED group having a color temperature of approximately 6000K, while the minimum position of the dimmer control could correspond to point B at the lowest value of the color path, such as an LED group having a color temperature of approximately 1700 K. Variation in the relative intensity or activation times (i.e., duty cycles) of the multiple LEDs, as controlled by the driver, may create intermediate color temperatures between the temperatures of the endpoints. Such intermediate values on the path could correspond to the intermediate positions of the dimmer control, allowing a smooth adjustment of the color temperature independent from any other light quality, including intensity. Similar to an adjustment of light intensity from the motion of the dimmer, a color feature may be adjusted relative to the position of the dimmer control. The variety of available values is dependent upon the number of LED groups having unique color features. If only two color features are present in an implementation, the color path is limited to a straight line of values between the points of the two features (not shown in FIG. 7*a*). If additional LED groups with additional color features are present, they may be used to adjust the light output such that it may follow a curved path between the endpoints instead of a straight line.

Figure 7B:
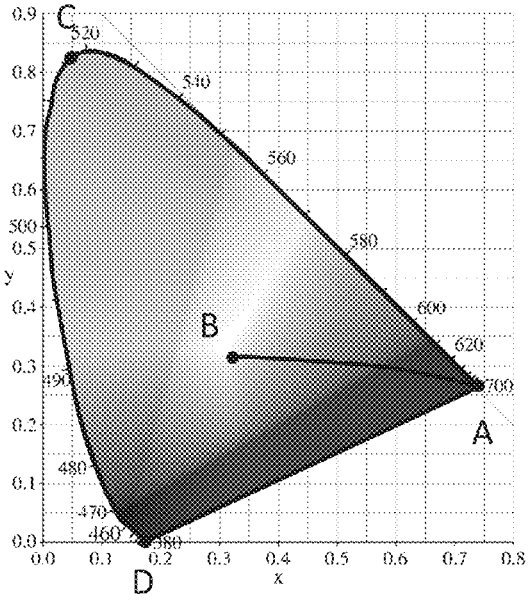

In a different implementation, the color feature to be adjusted may be a color or combination of colors, and the adjustment of the feature may be along a color path of adjacent values in a suitable model. FIG. 7*b* illustrates two such examples, including adjusting the combined red-white color between the endpoints of A and B, and adjusting the color along a standard rainbow spectrum following the path that includes the points A, C and D. For the example of the red-white feature, the minimum position of the dimmer control could correspond to the endpoint A as most red, while the maximum position could correspond to the endpoint B as most white. For the example of the rainbow spectrum, the point A could correspond to a certain position of a rotary dimming control, while the points C and D could correspond to second and third positions of the rotary control. If the control does not have fixed positions for maximum or minimum, the adjustment may be cyclical, corresponding to a cyclical path such as the example defined by points A, C, and D.

In all examples, the choice of what type of dimmer control to use may be selected as appropriate. It is equally suitable for a sliding control to represent a continuous spectrum path such as the A-C-D path (FIG. 7*b*), and for a rotary control to represent the path of A-B (FIG. 7*b*). Likewise, the selection of which point corresponds to the maximum or minimum position of the dimmer control may also be selected as desired. In addition, the continuous adjustment of a color feature need not be linear in proportion to the motion of the dimmer control.

It will be apparent to those skilled in the art that the described exemplary systems are generally descriptive and not limiting. The systems or components of the systems may be recombined, or substituted with generally-known equivalent systems or components, without changing the inventive aspect. An equivalent component here also includes equivalent inputs and outputs, such as (but not limited to) an equivalent input to indicate status information regarding the main power supply or the lighting elements.

What is claimed is:

1. An LED driver, comprising:

at least two outputs, wherein a first output is capable of connecting to a first plurality of LEDs and a second output is capable of connecting to a second plurality of LEDs, the first plurality of LEDs having a first color feature and the second plurality of LEDs having a second color feature; and an input, wherein the input is capable of connecting to a dimmer control;

wherein the LED driver is operable to:

enter a dimming mode wherein the LED driver controls a combined intensity of the first plurality of LEDs and the second plurality of LEDs based upon a first signal received from the dimmer control;

transition from the dimming mode to a color feature mixing mode based upon a second signal received from the dimmer control, wherein the second signal indicates a mode change;

while in the color feature mixing mode, control the first plurality of LEDs and the second plurality of LEDs to provide color feature mixtures based on a third signal received from the dimmer control;

responsive to receiving an additional signal from the dimmer control, save the color feature mixtures; and control the first plurality of LEDs and the second plurality of LEDs to, subsequent to powering off and restoring power to the first plurality of LEDs and the second plurality of LEDs, provide the saved color feature mixture.

2. The LED driver of claim 1, wherein a value of the first color feature is different from a value of the second color feature.

3. The LED driver of claim 2 wherein the LED driver controls the first plurality of LEDs and the second plurality of LEDs so that the color feature mixtures correspond to values along a color path between the values of the first and second color features.

4. The LED driver of claim 1, wherein the first and second color features each comprise any of color, color temperature, and tint.

5. The LED driver of claim 1, wherein the driver is further operable to:

transition to a second color feature mixing mode based upon a fourth signal received from the dimmer control indicating a second mode change; and while in the second color feature mixing mode, control the first and second pluralities of LEDs to provide a second color feature mixture based on additional signals received from the dimmer control.

6. The LED driver of claim 1, wherein the dimmer control is one of a phase dimmer and a 0-10 volt dimmer.

7. An LED driver, comprising:

at least two outputs, wherein a first output is capable of connecting to a first plurality of LEDs and a second output is capable of connecting to a second plurality of LEDs, the first plurality of LEDs having a first color feature and the second plurality of LEDs having a second color feature; and at least two inputs, wherein each input is capable of connecting to a particular dimmer control;

wherein the LED driver is operable to:

enter a dimming mode wherein the LED driver controls a combined intensity of the first plurality of LEDs and the second plurality of LEDs based upon a first signal received from a first dimmer control;

transition from the dimming mode to a color feature mixing mode based upon a second signal received from a second dimmer control, wherein the second signal indicates a mode change; and while in the color feature mixing mode, control the first plurality of LEDs and the second plurality of LEDs to provide color feature mixtures based on a third signal received from the first dimmer control.

8. The LED driver of claim 7, wherein a value of the first color feature is different from a value of the second color feature.

9. The LED driver of claim 8 wherein the LED driver controls the first plurality of LEDs and the second plurality of LEDs so that the color feature mixtures correspond to values along a color path between the values of the first and second color features.

10. The LED driver of claim 7, wherein the first and second color features each comprise any of color, color temperature, and tint.

11. The LED driver of claim 7, wherein the driver is further operable to:

transition to a second color feature mixing mode based upon a fourth signal received from the second dimmer control indicating a second mode change; and while in the second color feature mixing mode, control the first and second pluralities of LEDs to provide a second color feature mixture based on additional signals received from the first dimmer control.

12. The LED driver of claim 7, wherein the first dimmer control and the second dimmer control are each one of a phase dimmer or a 0-10 volt dimmer.

13. A method of adjusting a color feature mixture provided by a first plurality of LEDs and a second plurality of LEDs, the first plurality of LEDs having a first color feature and the second plurality of LEDs having a second color feature, the first and second pluralities of LEDs being connected to an LED driver, and the LED driver being connected to at least one dimmer control, the method comprising:

entering a dimming mode wherein the LED driver controls a combined intensity of the first and second pluralities of LEDs based upon a first signal received from the dimmer control;

upon receiving a second signal from the dimmer control indicating a mode change, transitioning the LED driver from the dimming mode to a color feature mixing mode;

while in the color mixing mode, controlling the first and second pluralities of LEDs to provide color feature mixtures based on a third signal received from the dimmer control;

responsive to receiving an additional signal from the dimmer control, save the provided color feature mixtures; and control the first plurality of LEDs and the second plurality of LEDs to provide the saved color feature mixtures subsequent to change of a power state.

14. The method of claim 13, wherein a value of the first color feature is different from a value of the second color feature.

15. The method of claim 14, wherein the LED driver controls the first plurality of LEDs and the second plurality of LEDs so that the color feature mixtures correspond to values along a color path between the values of the first and second color features.

16. The method of claim 13, wherein the first and second color features each comprise any of color, color temperature, and tint.

17. The method of claim 13, further comprising:

upon receiving a fourth signal from the dimmer control indicating a second mode change, transitioning to a second color feature mixing mode; and while in the second color feature mixing mode, controlling the first and second pluralities of LEDs to provide a second color feature mixture based on additional signals received from the dimmer control.

18. The method of claim 13, wherein the dimmer control is a phase dimmer.

19. The method of claim 13, wherein the dimmer control is a 0-10 volt dimmer.

20. An LED driver, comprising:

at least two outputs, wherein a first output is capable of connecting to a first plurality of LEDs and a second output is capable of connecting to a second plurality of LEDs, the first plurality of LEDs having a first color feature and the second plurality of LEDs having a second color feature; and at least two inputs, wherein each input is capable of connecting to a particular dimmer control;

wherein the LED driver is operable to:

enter a dimming mode wherein the LED driver controls a combined intensity of the first plurality of LEDs and the second plurality of LEDs based upon a first signal received from a first dimmer control; and enter a color feature mixing mode wherein the LED driver controls the first plurality of LEDs and the second plurality of LEDs to provide color feature mixtures based on a second signal received from a second dimmer control.

* * * * *